United States Patent [19]

Isonaka et al.

[11] 3,934,256

[45] Jan. 20, 1976

[54] IDENTIFICATION CARD PRODUCING APPARATUS

[75] Inventors: Kenji Isonaka, Tokorozawa; Saburo Hokari, Kawasaki; Tatsuya Watanabe, Yokohama; Masamichi Furukawa, Kawasaki, all of Japan

[73] Assignee: Ricoh Co., Ltd., Tokyo, Japan

[22] Filed: May 21, 1973

[21] Appl. No.: 362,245

[30] Foreign Application Priority Data

May 23, 1972 Japan ..... 47-51010

[52] U.S. Cl. ..... 354/3; 355/3 TE; 355/72

[51] Int. Cl.[2] ..... G03G 15/22

[58] Field of Search ..... 355/3 R, 8, 11, 17, 16, 355/72, 73, 74, 75, 76; 95/1 R, 1 A, 1.1; 354/3

[56] References Cited

UNITED STATES PATENTS

| | | | |
|---|---|---|---|
| 2,598,732 | 6/1952 | Walkup | 355/17 X |
| 2,831,409 | 4/1958 | Bixby et al. | 355/3 R |
| 2,892,391 | 6/1959 | Mayo et al. | 355/16 X |
| 3,063,351 | 11/1962 | Medley | 355/3 R |
| 3,115,814 | 12/1963 | Kaprelian | 355/3 R |
| 3,120,790 | 2/1964 | Carlson et al. | 355/3 R |
| 3,280,695 | 10/1966 | Brandt | 355/76 X |
| 3,499,709 | 3/1970 | Uhlenberg | 355/3 R |
| 3,552,957 | 1/1971 | Hodges | 355/3 R X |
| 3,598,579 | 8/1971 | Robinson | 355/3 R X |
| 3,715,156 | 2/1973 | Levy | 355/16 |
| 3,759,610 | 9/1973 | McVittie | 355/17 |

*Primary Examiner*—Monroe H. Hayes
*Assistant Examiner*—Kenneth C. Hutchison
*Attorney, Agent, or Firm*—Cooper, Dunham, Clark, Griffin & Moran

[57] ABSTRACT

An apparatus for producing identification cards including a photograph of a person and written material by using electrostatic and transfer printing techniques. A photoreceptor comprising a layer of photoconductive material on a conductive supporter is charged and is exposed to an optical image of a person to form an electrostatic latent image of the person on the photoconductive material layer. An identification card material comprising a layer of dielectric material on a conductive supporter is placed on top of the photoreceptor to transfer print the electrostatic latent image from the photoreceptor to the identification card material. Toner particles are then supplied to the dielectric material layer of the identification card material to develop the electrostatic latent image thereon into a visible image. Written matter may then be entered on the identification card material, and the identification card material may be protected by lamination.

7 Claims, 50 Drawing Figures

IDENTIFICATION CARD PRODUCING APPARATUS

BACKGROUND OF THE INVENTION

The invention is in the field of devices for producing identification cards such as credit cards, bank I.D. cards, student and employee I.D. cards, and the like.

Two general types of identification cards are now in use. One type includes only printed written or otherwise marked information, and the other type includes, in addition, a photograph of the card user. The type including a photograph is generally preferable because it facilitates a more positive identification of the person authorized to use the card.

One prior art method of making identification cards including a photograph involves making a conventional photograph which is then pasted or otherwise secured to the identification card. Thereafter, it is common to apply an embossed seal to the photograph and to the card to which it is affixed, and to laminate the card in a plastic sheet. It can be appreciated that several distinct operations are involved and that they are time consuming. Additionally, it can be appreciated that the conventional photograph, which relies on a silver salt photographic print involves relatively complex preparation and is subject to fading. It is therefore desirable to provide apparatus for producing efficiently and inexpensively identification cards which include an image of the person or persons authorized to use the card.

SUMMARY OF THE INVENTION

The invention relates to devices for making identification cards such as credit cards, student and employee cards and the like, which include an image of the person or persons authorized to use the card.

An object of the invention is to provide devices for making such identificatin cards in a simple, efficient, and inexpensive manner. This and other objects of the invention are carried out in an apparatus which uses electrophotographic and transfer printing techniques.

The present invention includes charging a photoreceptor and exposing it to an optical image of a person or persons to thereby form an electrostatic latent image thereof on the photoreceptor. A card material comprising a dielectric material layer on a conductive supporter is pressed against the photoreceptor carrying the latent image to thereby transfer the latent image from the photoreceptor onto the card material by transfer printing. The transferred latent image on the card material is then developed into a visible image with toner particles. The card may be protected by lamination.

Prior to transfer-printing, written or otherwise marked information may be entered on the card material, and the same card material is then used for transfer-printing thereon the latent image from the photoreceptor. The card material may be stiff and relatively thick so that the identification card made of such material may be durable and convenient to carry.

Because the card material is stiff and fixed at the start, it is unnecessary to apply a backing material to the card after it is ready for lamination. The device embodying the invention includes various ingenious arrangements for smoothly handling the stiff and relatively thick starting card material.

DETAILED DESCRIPTION

Figure 1:
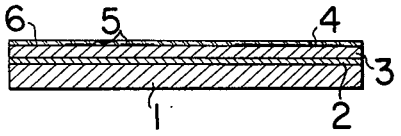
FIG. 1 is a sectional view of an identification card produced by the apparatus according to the invention.

An identification card prepared in accordance with the subject invention is illustrated in FIG. 1 and comprises a supporter 1, a conductive material layer 2 deposited over the supporter 1, and a dielectric layer 3 deposited over the conductive material layer 2. A toner image 4, which may be the photographic image of a person, is on the dielectric layer 3, and markings 5, which may be printed or handwritten matter, stamps and the like are also on the dielectric layer 3. A transparent protective layer 6 is deposited over the dielectric layer 3 to protect the toner image 4 and the markings 5 thereon.

The supporter 1 may be a relatively thick sheet of paper or of a synthetic resinous material and its stiffness may be further increased by applying a backing material to it. The conductive material layer 2 may be deposited on the supporter 1 by vapor deposition of aluminum in vacuum, or by other suitable means. The dielectric material layer 3 may be of a material such as an acrylic resin, methacrylic resin, vinyl chloride or the like, and may be deposited on the conductive material layer 2 by the use of a binder. The dielectric material layer 3 may be formed by using a binder including a photoconductive material, such as zinc oxide, polyvinyl carbazol or the like. If a sheet of a suitable metal or of rubber is used as the supporter 1, the conductive material layer 2 may be eliminated. The toner image 4 may be formed by first forming an electrostatic latent image of a person and then developing the latent image such as by powedered toner particles. The markings 5 may be entered by printing, stamping or handwriting or by any other suitable means. The transparent material layer may be formed by applying a film of vinyl chloride or other synthetic resinous material, or by applying a solution of a synthetic resinous material used as a laminating material, or by immersing the card in such solution.

It is noted that an identification card of the type described above does not rely on silver salt photography and can therefore be produced without the cumbersome steps involved in producing a photographic print. Further, the prior art need to paste a silver salt photographic print onto an identification card, to affix a seal to the card material or to make another type of an impression on the photographic print and an the card material is eliminated, because the entry of markings necessary for identifying the card user may be made directly on the surface of the photographic image either by handwriting, printing, stamping, or the like.

Still further, the toner image formed in accordance with the invention is not subject to fading. The toner image formed on an identification card in accordance with the invention has a sufficient range of half tones, and it is neither too sharp in contrast or too poor in contrast as sometimes happens with ordinary photographic images. The toner image is of high quality and is effective to identify the card user.

Figure 2:
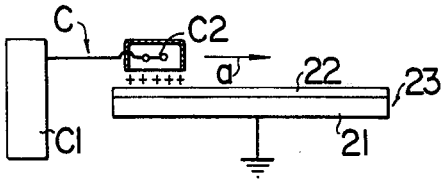
FIGS. 2 through 9 are schematic views referred to in explaining the major functional steps involved in producing an identification card by the invented device.

The invention may be explained in a simplified manner by reference to the seven basic steps discussed in connection with FIGS. 2 through 9. These steps are as follows:

Step 1 (FIG. 2). A photoreceptor 23 comprises a photoconductive material layer 22 deposited on a supporter 21 which is electrically conductive. The supporter 21 may be made of material such as aluminum, copper or other electrically conductive materials, and the photoconductive material layer 22 may be vapor deposited in vacuum and may comprise materials such as selenium, zinc oxide, poly-N-vinyl carbazol or other photoconductive materials. The photoconductive material layer 22 is uniformly charged throughout its entire surface by a corona discharge produced by a charger C having a wire electrode C2 connected to a high voltage power source C1 and moved in the direction of an arrow *a*.

A high bias voltage of a polarity consistent with the charge characteristics of the photoconductive material layer 22 is impressed on the wire electrode C2 in order to suitably charge the layer 22. For example, if the layer 22 comprises selenium, the bias voltage would be positive. A bias voltage of the opposite polarity is impressed on the supporter 21, or the supporter 21 may be grounded as shown. The supporter 21 may be backed or framed by a suitable insulating plate (not shown).

Figure 3:
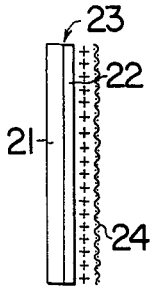

Step 2 (FIG. 3). A screen 24 is disposed immediately adjacent the photoconductive material layer 22 after the layer 22 is uniformly charged throughout its entire surface. The screen 24 may be a fine mesh screen of a material such as insulated synthetic resinous material sheet formed with a plurality of very small openings by a process such as photo-etching. Alternately, the screen 24 may be a glass sheet ruled with a fine grid of cross lines. The purpose of the screen 24 is to produce a mesh point effect in the image which is projected onto the photoconductive material layer 22 in the next step 3. The size of the opening of the mesh screen 24 is selected to produce dots which are beyond the resolving power of the human eye at a normal reading distance.

Figure 4:
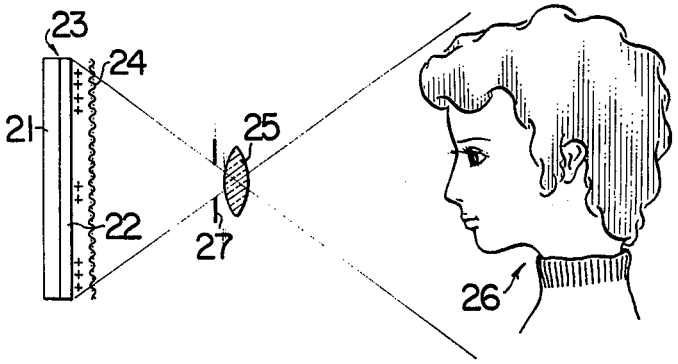

Step 3 (FIG. 4). The photoconductive material layer 22 is exposed to an optical image of a person 26 through a projection lens 25. The fine mesh screen 24 is between the photoconductive layer 22 and the projection lens 25. A diaphragm 27 is opened for a suitable period, such as 1/30th of a second. The sensitivity of the photoconductive material layer 22 may be increased by using a coloring matter or other sensitivity increasing agent. The spacing between the fine mesh screen 24 and the photoconductive material layer 22 is selected such that the screen mesh can be photographed on the surface of the photoconductive material layer 22 by the projection lens 25. It should be clear that a photographic latent image on the layer 23 may be formed by photographing either a person 26, or a photograph or another image thereof, or by photographing another object.

Figure 5:
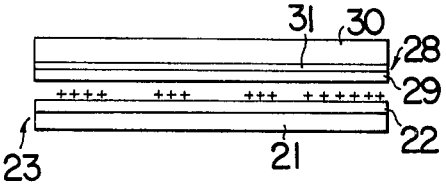

Step 4 (FIG. 5). After a latent image is formed on the layer 23 in step 4, a sheet of card material 28 is brought in contact with the photoreceptor 23 such that the dielectric material layer 29 of the card material 28 faces the latent image bearing photoconductive material layer 22 of the photoreceptor 23. The photoelectric latent image is transferred to the dielectric material layer 29 of the card material 28 by transfer printing. The card material 28 is identical with the card material discussed in connection with FIG. 1, except that it does not have the transparent layer 6 or the markings 5 or the toner image 4 of the card material shown in FIG. 1. Transfer printing of the type shown in FIG. 5 can be carried out by pressing the photoreceptor 23 and the card material 28 against each other with sufficient force, such as by a suitable roller arrangement. The conductive material layer 31 of the card material 28 may be electrically grounded, or a bias voltage of a suitable polarity and level may be impressed on the conductive material layer 31, as is conventional in transfer-printing.

Figure 6:
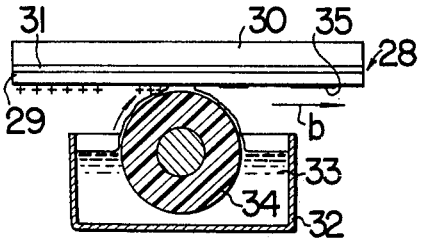
Figure 7:
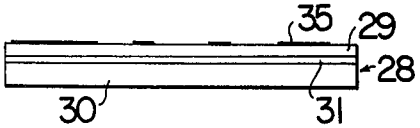

Step 5 (FIGS. 6 and 7). After step 4, the card material 28 bears an electrostatic latent image. The purpose of step 5 is to develop this latent image into a visible image. This may be done by suitable developing means such as the means illustrated schematically in FIG. 6 where the card material 28 is conveyed by suitable conveyor means (not shown) in the direction of an arrow *b* and the dielectric material layer 29 thereof is brought in contact with the periphery of a developing roller 34 which is partly immersed in a developing liquid 33 in a container 32. The developing roller 34 may be a conductive metallic roller made of materials such as copper or aluminum, or may be a conductive rubber roller. The developing liquid 33 includes fine toner particles which are supplied to the electrostatic latent image to convert it into a visible toner image 35. Any other suitable device for developing electrostatic latent images may be used. The toner contained in the developing agent may comprise fine powder of carbon black or other pigment treated with a resin.

Figure 8:
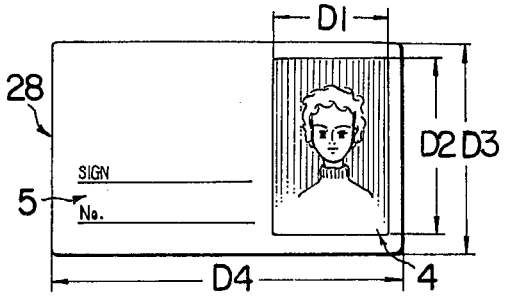

Step 6 (FIG. 8). Markings such as the signature and identification number, and other particulars of the card user may be entered on the same surface of the card material 28 which bears the developed visible image 35. The markings may be entered by handwriting, typing, printing, stamping or the like.

Figure 9:
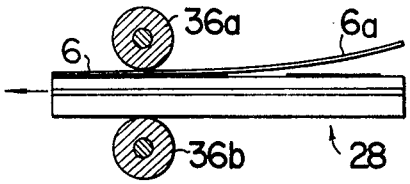

Step 7 (FIG. 9). A transparent protective film 6*a* is laminated onto the surface of the card material 28 which bears the visible image and the markings. The lamination is carried out with the help of laminating rollers 36*a* and 36*b* in a conventional manner. After lamination, the identification card according to the invention is ready for use. It should be clear that instead of laminating, the card material may be protected by other suitable means, such as by synthetic resinous material in liquid form applied to the card material surface, or the card material may be impregnated with such liquid.

The seven steps discussed above are only a brief and simplified explanation of some of the major steps involved in practicing the invention. A specific device embodying the invention is described below.

Figure 10:
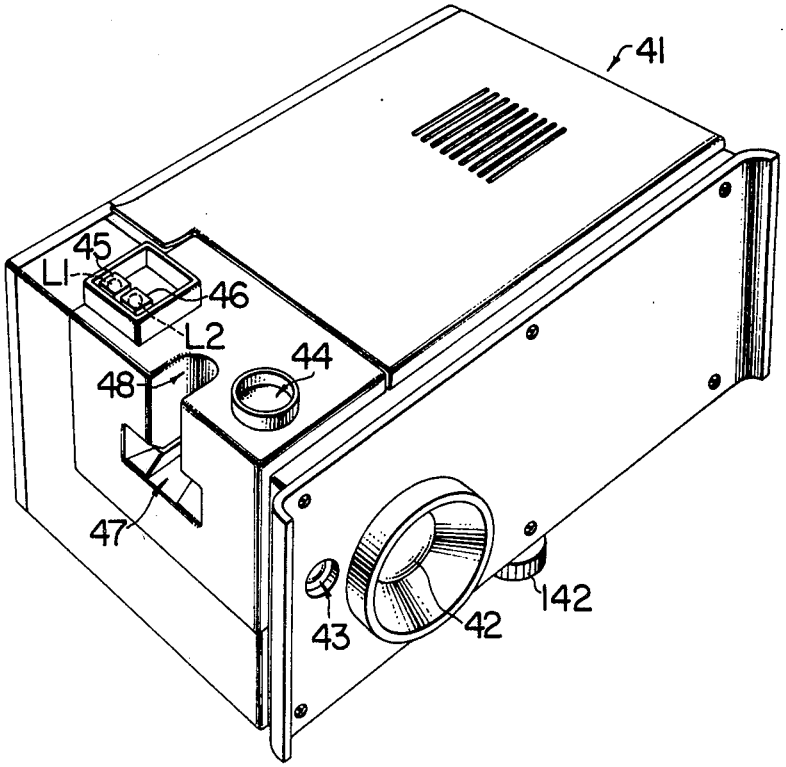
FIG. 10 is a perspective view of an identification card producing device comprising one embodiment of the invention.

Referring to FIG. 10, an identification card producing device according to the invention comprises a casing 41 which has a front side with a taking lens 42 and a finder objective window 43. The top side of the casing 41 has a finder window 44, a push-button 45 for a main off-on switch SW1 and a push-button 46 for a shutter release switch SW2. The push-button 45 has a built-in lamp L1 to indicate that the device is on, and the push-button 46 has a built-in lamp L2 to indicate that the shutter release is operable as subsequently described in connection with FIG. 49.

Figure 11:
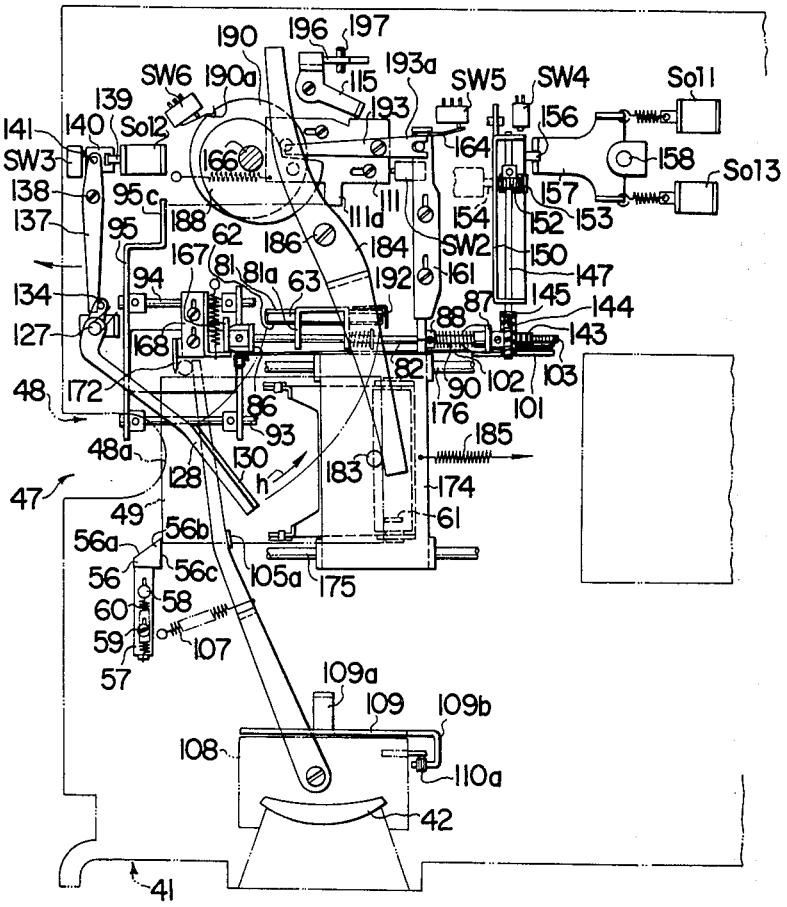
FIG. 11 is a plan view showing the internal structure of the device shown in FIG. 10.

Referring to FIG. 10 again, a cutout 48 is formed in the upper portion of the card material feed port 47 at the left side of the device 41. A card material 49 (see FIG. 11) may be inserted in the port 47 and is pushed rightwardly to a position in which its trailing end is substantially aligned with an innermost edge 48*a* of the cutout 48 (FIG. 11). The card material 49 is identical with the card material 28 discussed above.

Figure 13:
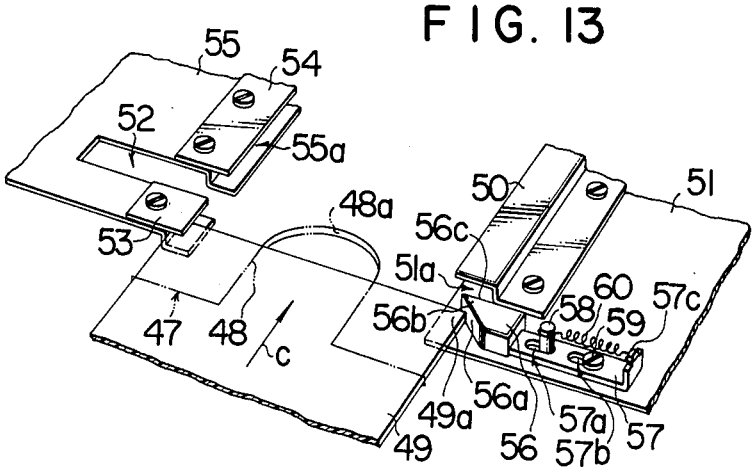
FIG. 13 is a schematic view showing the construction of a card material passage near a card material inserting port of the device of FIG. 10.

Referring to FIG. 13, support plates 51 and 55 are disposed inwardly of the card material feed port 47 of the casing 41. The support plate 51 has a support bar 50 mounted on one marginal portion thereof to define a guide recess 51*a*, and the support plate 55 has a cutout 52 and a support bar 54 to define an outer guide recess 55*a*. The two guide plates 51 and 55 are disposed such that the card material 49 inserted through the port 47 moves in the direction of an arrow *c* with the side margins of the card material 49 received within the guide recesses 51*a* and 55*a*. The vertical dimension of the guide recesses 51*a* and 55*a* is such that the card material 49 can be maintained in a horizontal position as the card moves in the direction of the arrow *c*. Referring still to FIG. 13, a positioning member 56 is disposed at the right forward side of the card material feed port 47. The positioning member 56 has an inwardly inclined edge 56*a* to guide the right front shoulder 49*a* of the card material 49 as it is inserted into the port 47. The positioning member 56 is secured to one end of a bar 57 which has slots 57*a* and 57*b* and is slidably supported on the support 51 by a pin 58 extending from the support plate 51 and loosely received in the slot 58*a*. A screw 59 is threaded into the support plate 51 and is loosely received in the slot 57*b* of the bar 58. The bar 57 has at its right-hand end an upwardly bent portion 57*c*, and a spring 60 connects the upwardly bent portion 57*c* and the pin 58 to urge the bar 57 leftwardly.

When the card material 49 is inserted through the port 47 into the casing 1, the right front shoulder 49*a* thereof pushes the positioning member 56 out of the card material passage against the biasing force of the spring 60. As the card material 49 is pushed further into the casing 60, the left edge of the positioning member 56 is maintained in engagement with the right-hand side of the card material 49. However, when the trailing end of the card material 49 has passed through this portion of the passage, the positioning member 56 is moved leftwardly by the spring 60, such that its left-hand portion 56*b* is again disposed in the passage of the card material (FIG. 11).

The positioning member 56 has a major edge 56*c* which engages the trailing end of the card material 49 to correctly position the card material when it is pushed backwardly by a card material push-back pawl 61 after it has been pushed in to the casing 41. This position of the card material 49 is shown in FIG. 11. As described in detail below, the position of the card material 49 shown in FIG. 11 is the transfer printing position in which the card material 49 and a photoreceptor 62 (FIG. 12) are pressed against each other so that an electrostatic latent image which is at this time on the photoreceptor 62 is transferred onto the card material 49. The photoreceptor 62 is identical in construction with the photoreceptor 23 discussed in connection with FIGS. 2 through 5.

The photoreceptor 62, and several ways of mounting the photoreceptor 62 onto a backing plate 63 (which corresponds to the backing plate 21 of FIGS. 2 through 5) are shown in detail in FIGS. 30 through 39.

Figure 30:
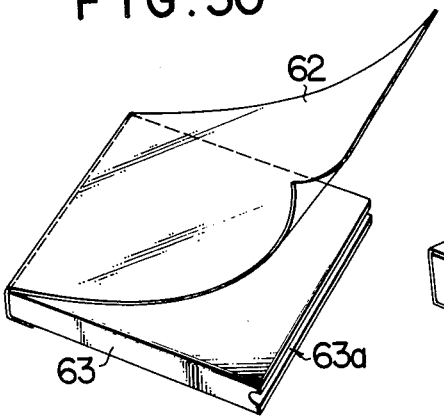
FIGS. 30 and 31 are perspective views showing the manner in which the photoreceptor is mounted on a backing plate.
Figure 31:
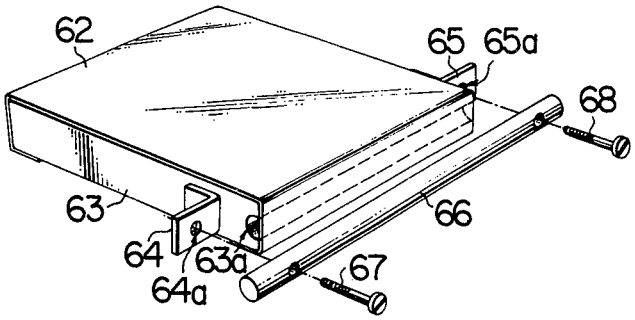

Referring to FIGS. 30 and 31, the photoreceptor 62 is shown as a relatively thin sheet and the backing plate 63 is shown as a relatively thick plate having a U-shaped groove 63*a* at its back edge. The photoreceptor 62 is sufficiently long so that its front and back ends can fold over the front and back ends respectively of the backing plate 63.

Figure 32:
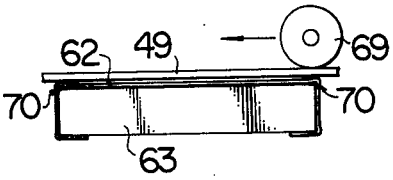
FIGS. 32 through 39 are side views showing means for stretching the photoreceptor when it is mounted on the backing plate.

The photoreceptor 62 is used to form thereon an electrostatic latent image and then to transfer this electrostatic latent image onto the card material 49 by transfer printing. A transfer printing operation of this type is illustrated schematically in FIG. 32, and it can be seen that it is desirable that the photoreceptor 62 be tightly stretched over the backing plate 63 in order to avoid distortions of the transferred image. As seen in FIG. 32, if the top portion of the photoreceptor 62 is not properly tensioned over the backing plate 63, wrinkles and other distortions may form as a transfer printing roller 69 is moved in the indicated direction.

Several suitable arrangements for tensioning the photoreceptor 62 over the backing plate 63 are shown in FIGS. 31 and 33 through 39. Referring to FIG. 31, a pair of mounting members 64 and 65 are secured to the sides of the backing plate 63 which flank the groove 63*a*. A round bar 66 is inserted in the groove 63*a*, over the folded end of the photoreceptor 62, and screws 67 and 68 are inserted through suitable openings in the round bar 66 and are threaded into suitable threaded openings 64*a* and 65*a* respectively of the mountinig members 64 and 65 to fasten the round bar 66 to the backing plate 63 and to thereby tension the photoreceptor 62.

Figure 33:
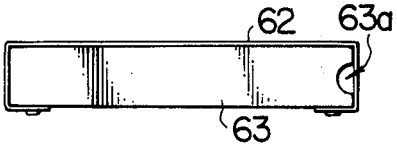
Figure 34:
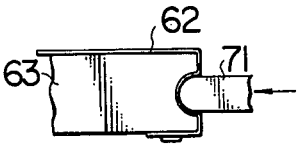
Figure 35:
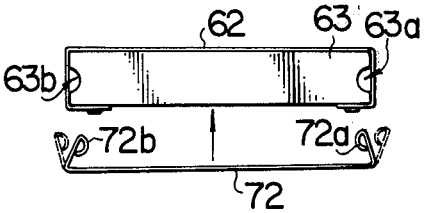
Figure 36:
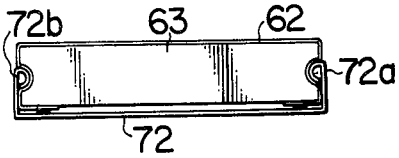
Figure 37:
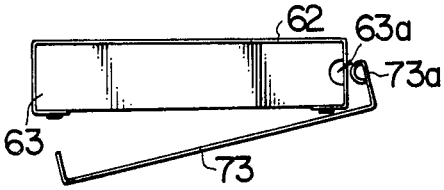
Figure 38:
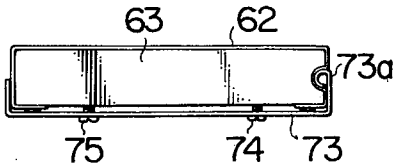

Referring to FIG. 33, the photoreceptor 62 may be secured to the backing plate 63 by suitable screws fastening the folded over ends of the photoreceptor 62 to the underside of the backing plate 63. Alternately, the folded over ends of the photoreceptor 62 may be adhesively bonded to the underside of the backing plate 63. When the photoreceptor 62 is secured to the backing plate 63 as shown in FIG. 33, the photoreceptor 62 may be tensioned by a keep bar 71 disposed as shown in FIG. 34. The function of the keep bar 71 is similar to that of the round bar 66 shown in FIG. 31. An alternate way of tensioning the photoreceptor 62 is shown in FIGS. 35 and 36 and involves the use of a resilient stopper plate 72 having stopper ends 72*a* and 72*b*. The stopper plate 72 is attached to the underside of the backing plate 63 and the end stoppers 72*a* and 72*b* thereof are inserted in grooves 63*a* and 63*b* respectively of the backing plate 63 over the folded ends of the photoreceptor 62. An alternate type of a stopper plate is shown in FIGS. 37 and 38 where a stopper plate 73 has a single stopper end 73*a* which cooperates with a groove 63*a* in the backing plate 63.

Figure 39:
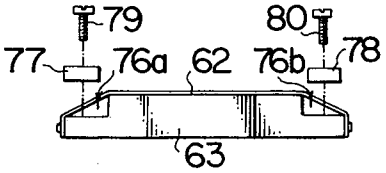

A still alternate manner of tensioning the photoreceptor 62 over the backing plate 63 is illustrated in FIG. 39 and involves the use of a stopper plate 63 having offset portions 76*a* and 76*b* at its front and back ends respectively. After the front and back ends of the photoreceptor 62 are secured to the front and back sides of the backing plate 63 respectively by suitable screws or otherwise, keep bars 77 and 78 are placed on the offset portions 76*a* and 76*b* respectively, over the front and back ends of the photoreceptor 62 respectively, and are fastened to the backing plate 63 by suitable screws 79 and 80 to tension the photoreceptor 62.

Figure 12:
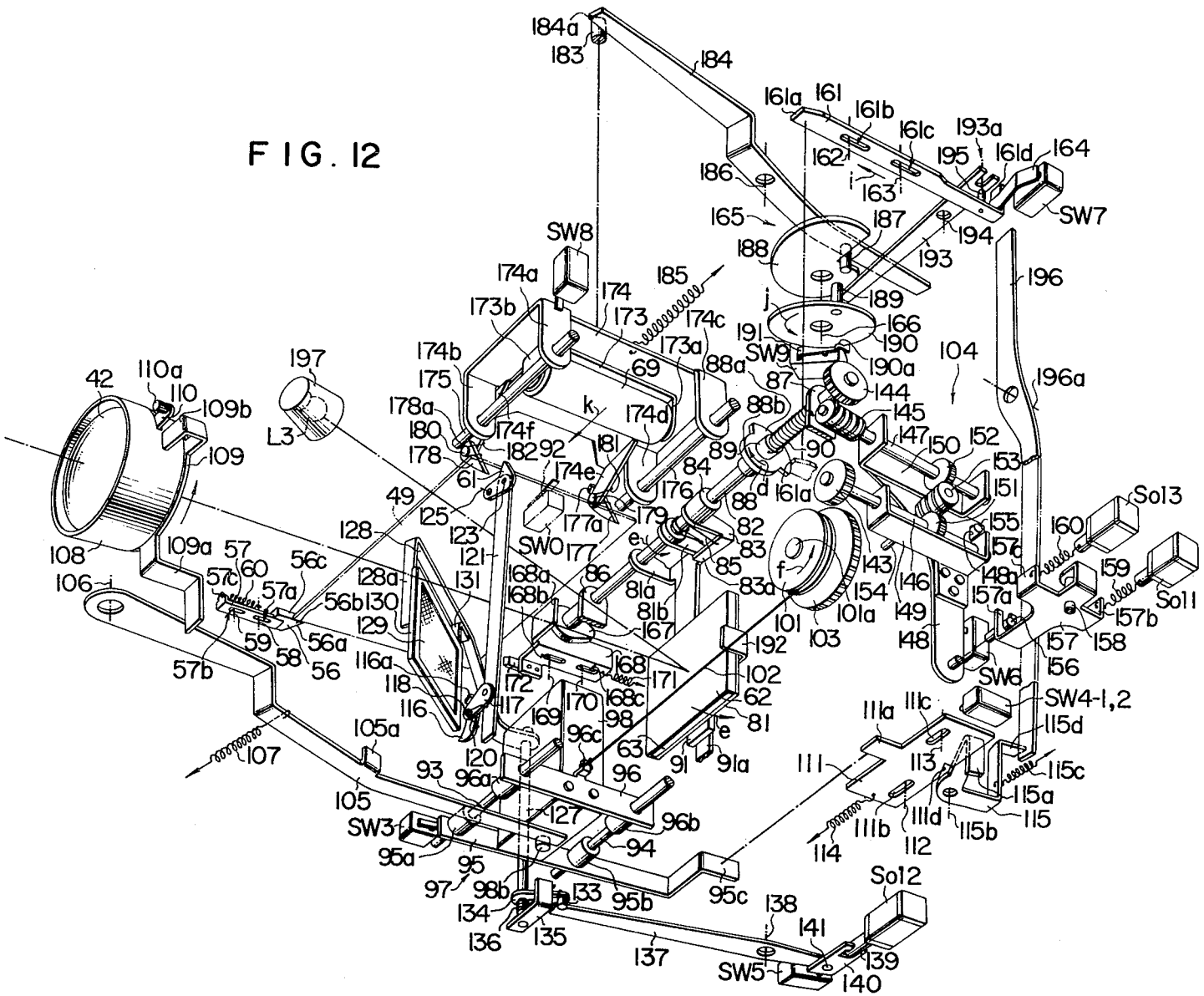
FIG. 12 is a schematic view showing the internal structure of the device of FIG. 10 as seen from below.

Referring to FIG. 12, a photoreceptor 62 mounted on a backing plate 63 in one of the several possible ways discussed above is mounted on a photoreceptor support plate 81. The plate 81 has arms 81*a* and 81*b* that are loosely supported by a shaft 82 disposed on the right side of the card material passage and parallel thereto, so that the photoreceptor 62 is maintained in the photographic position shown in FIG. 12.

Arm means 83 are disposed to the right of the arm 81*b* and are firmly secured to the shaft 82 at a tubular portion 84 thereof. The arm means 83 are bent substantially in the middle so that the front end 83*a* thereof may be disposed beneath the arm 81*b*. A coil spring 85 urges the arm 81*b* toward a pressing engagement with the forward end 83*a* of the arm means 83.

The shaft 82 is rotatably supported by fixed supporters 86 and 87, and a cam 88 having an arcuate major diameter portion 88*a* is secured to a portion of the shaft 82, on the side of the supporter 87, by a boss 89 thereof which is fitted over the shaft 82. The shaft 82 is urged to rotate in the direction of the arrow *e* by the biasing force of a coil spring 90.

The supporter 81 is maintained in engagement with a plate shaped stopper 91 as the shaft 82 tends to rotate in the direction of the arrow *e* under the biasing force of the spring 90. The stopper 91 is positioned by a positioning member 91*a* so that the photoreceptor 62 can be correctly positioned at its photographing position relative to the taking lens 42.

Two rails 93 and 94 are parallel to each other and to the surface of the photoreceptor 62 and are disposed in front of and below the photoreceptor 62. The rails 93 and 94 have bosses 95*a*, 95*b*, 96*a*, and 96*b* which are fitted over two charging device support bars 95 and 96 respectively to thereby mount the bars 95 and 96 slidably on the rails 93 and 94 respectively.

Figure 14:
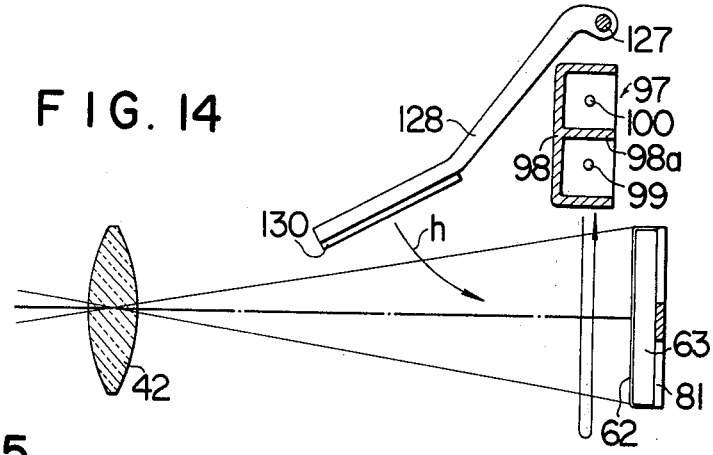
FIG. 14 is a plan view showing a charging device, a screen and a projection lens in relation to a photoreceptor forming a part of the device of FIG. 10.

The rails 93 and 94 of FIG. 12 support a charging device 97 which is illustrated in FIG. 14. Referring to FIG. 14, the charging device 97 includes a frame 98 affixed to the charging device support bars 95 and 96 and including wire electrodes 99 and 100 separated from each other by a partition 98*a*. A high bias voltage of a suitable polarity is impressed on the wire electrodes 99 and 100 by a suitable high voltage source Ch (FIG. 49) in the course of the charging step described below.

Figure 49:
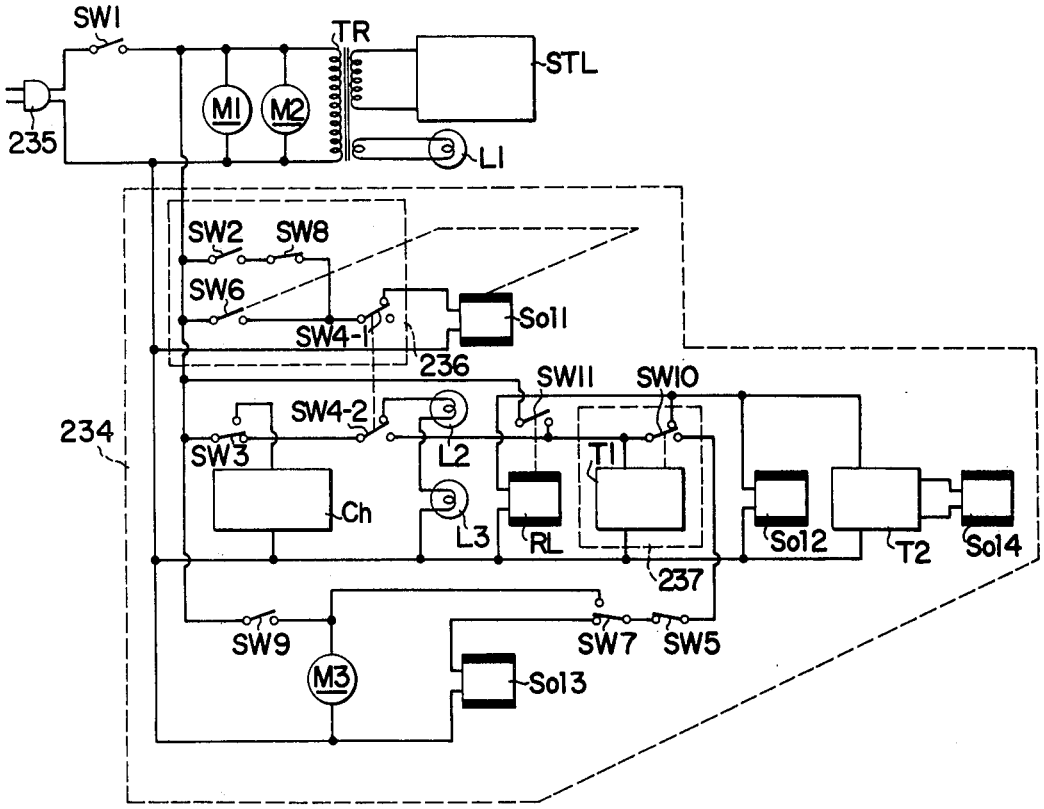
FIG. 49 is a circuit diagram showing control means for the apparatus of FIG. 10.

Referring back to FIG. 12, the charging device support bar 96 has at its center a projection 96*c* supporting one end of a wire 102 which is wound on a pulley 101. The pulley 101 is adapted to be connected through a gear 103, affixed to a shaft 101*a*, to a drive mechanism 104 connected to a motor M1 (FIG. 49). Referring to FIG. 49, upon the energization of a solenoid SOL1 after the shutter release SW2 is closed and a charging initiation command is issued, the gear 103 and the pulley 101 are connected to the drive mechanism 104 to start rotating in the direction of an arrow *f*.

Referring to FIG. 12, the charging device 97 is originally at its initial position leftwardly of the photographing position shown in the figure while in the initial position, the charging device support bar 95 keeps a switch SW3 in a depressed position. As the pulley 101 starts rotating in the direction of the arrow *f*, the charging device 97 is pulled by the wire 102 and passes by the front of the photoreceptor 62. At the same time, the switch SW3 is released from the depressed position and actuates the high voltage source Ch (FIG. 49), which impresses a suitable voltage on the wire electrodes 99 and 100 to thereby charge the entire surface of the photoconductive material layer of the photoreceptor 62 by a corona discharge. The motion of the charging device 97 is illustrated in FIG. 14.

Referring back to FIG. 12, a pin 98*b* is secured to the underside of the frame 98 of the charging device 97. A lever 105 has a front end which is disposed to the right of the pin 98*b* and is pivotally supported at its base by a shaft 106. The lever 105 is normally urged by the biasing force of a spring 107 to move clockwise. A shutter charging arm 109*a* is integral with a ring 109 mounted on a tube 108 of the projection lens 42. The arm 109*a* is disposed to the right of the base of the lever 105. The ring 109 has a pressing arm 109*b* designed to engage a set lever 110 for a shutter (not shown). When the charging device 97 moves from its initial position as described below, the shutter charging arm 109*a* is pushed and moved through the pin 98*d* and the lever 105. This rotates the ring 109 in the direction of the shown arrow such that the pressing arm 109*b* engages the projection 110*a* of the set lever 110 to thereby charge the shutter. It should be clear that other suitable shutter charging means may be employed. For example, a shutter of the type that is normally set may be employed and may be charged by a suitable motor actuated upon a suitable operation command.

A command to energize the solenoid SOL1 to move the charging device 97 from its initial position and to actuate the high voltage source Ch to start a corona discharge may be issued by a switch SW0 disposed below the passage of the card material 49 and having an actuator 92 adapted to be depressed by the card material 49 as it moves along its passage after being inserted in the card feed port 47 (FIG. 10). The switch SW0 may be disposed at any other suitable position, and may be replaced by suitable card material sensing means (not shown) using a photoelectric transducer element or the like. Alternately, the solenoid SOL1 may be actuated in response to the closing of the main switch SW1.

Referring to FIG. 12 again, the charging device support bar 95 extends to the right and has a bent end portion 95*c* adapted to depress a projection 11*a* formed in a plate shaped actuator 111 of a double throw switch SW4-1,2 when the charging device 97 moves from its initial position. The actuator 111 has slots 111*d* and 111*c* which receive support shafts 112 and 113 respectively for moving the actuator 111 in sliding motion in the same direction as the end portion 95*c* of the support bar 95. The actuator 111 is urged by the biasing force of a spring 114 to move away from the double throw switch SW4-1,2. When the bent end portion 95*c* of the support bar 95 depresses the projection 111*a*, the actuator 111 moves toward the double throw switch SW4-1,2 against the biasing force of a spring 114 to depress the switch SW4-1,2.

The double throw switch SW4-1,2 includes a switch SW4-1 whose function is to deenergize the solenoid SOL1 which actuates the gear 103 and the pulley 101. Thus, when the switch SW4-1 is closed, the charging device 97 starts returning to its initial position. When a lock lever 115 is brought into engagement with a cutout 111*d* formed in the actuator 111, the actuator 111 is locked in a position for holding the double throw switch SW4-1,2 in its depressed position. It should be understood that the double throw switch SW4-1,2 may be held in its depressed position by a self-holding circuit using a suitable relay (not shown), and that the charging device 97 may be returned to its initial position by eliminating the switch SW4-1 and using a timer (not shown) which is adapted to deenergize the solenoid SOL1 after a predetermined time delay following closing of the main switch SW1. The lock lever 115 is pivotally supported by a shaft 115*b* and is urged by the biasing force of a spring 115*c* to move into engagement with the cutout 111*d* formed in the actuator 111 as described above.

Figure 21:
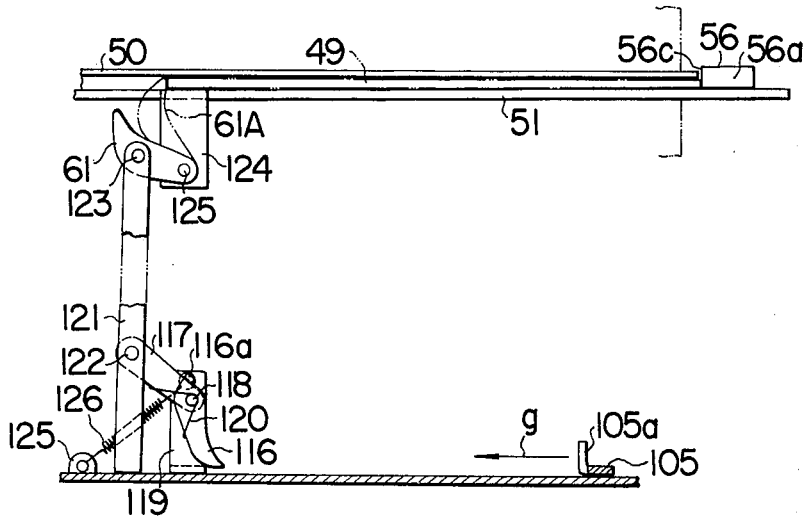
FIG. 21 is a side view of a return means for positioning a card material.

Referring to the left-hand portion of FIG. 12, a projection 105*a* extends upwardly from the central portion of the arm 105. A member 116 is loosely mounted on a shaft 118 that is loosely received through an end portion of an arm 117. The member 116 extends in the path of the pivotal movement of the projection 105. Referring to FIG. 21 for a clearer illustation, the shaft 118 is rotatably supported by a fixed supporter 119 and has thereon a spring 120 which is also secured to the member 116 and the arm 117. The member 116 has a portion 116*a* adapted to be engaged by the arm 117 to permit the arm 117 to act as a single unit with the member 116. The arm 117 is pivotally connected at its other end to a lower portion of a connector 121 that pivotally supports at its upper portion a push-back pawl 61 for pushing back the hard material 49 at the appropriate time. The pawl 61 is pivotally supported at its base through a shaft 125 by a supporter 124 affixed to the underside of a support plate 51.

When the arm 105 moves in the direction of an arrow *g*, in association with the movement of the charging device 97 from its initial position, the member 116 is pressed in the same direction by the projection 105 in the terminating stage of the movement of the arm 105. When pressed, the member 116 moves clockwise about the shaft 118, and the arm 117 also moves with the member 116 as a unit by virtue of the biasing force of a spring 120. The movement of the arm 117 is transmitted through the connector 121 to the pawl 61 which is moved from its position shown in solid line in FIG. 21 to the position shown in its dash and dot line in the same figure. The pawl 61 pushes th card material 49 backwardly and moves it until it engages the edge 56*c* of the positioning member 56. The force with which the arm 105 pushes the member 116 after the pawl 61 has pushed the card material 49 backwardly is absorbed by the spring 120.

When the charging device 97 begins to return to its initial position, the arm 105 is also restored to its original position, thereby releasing the member 116 from the pressure applied thereto. When a member 116 is released, the member 116, the arm 117, the connector 121 and the pawl 61 are all restored to their original positions by the biasing force of a spring 126 mounted between the portion 116*a* of the member 116 and a fixed member 125. When the solenoid SOL1 is deenergized and the gear 103 and the pulley 101 are rendered inoperative, the charging device 97 is pulled back to its initial position through the pin 98*b* and the arm 105 by the biasing force of the spring 107 mounted on the arm 105. At the same time the support bar 95 depresses the switch SW2, so that the charging voltage is no longer present.

Figure 15:
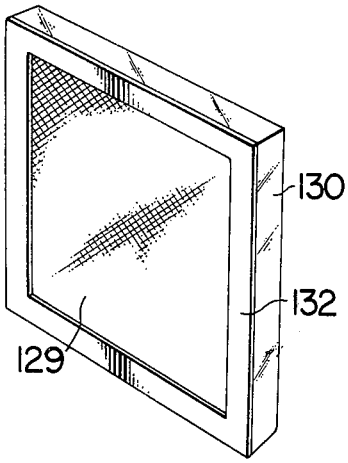
FIG. 15 is a perspective view of a screen ruled with fine cross lines to form a mesh thereon which is used in the device of FIG. 10.
Figure 16:
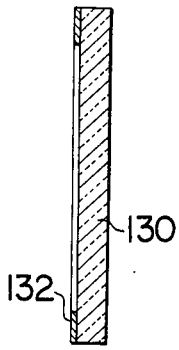
FIG. 16 is a sectional view of the screen of FIG. 15.

Referring back to FIG. 12, a screen support arm 128 is secured at its base to an upper end portion of a shaft 127 which is rotatably disposed to the left of the photoreceptor 62 which is at its photographing position. Secured to the support arm 128 is a screen 130 formed with a mesh 129 (FIGS. 15 and 16). The screen 130 is supported by a downwardly bent front end portion 128*a* of the arm 128 and by a stay 131 (FIG. 12). The screen 130 is identical in construction with the screen 24 discussed in connection with FIGS. 3 and 4 and has a margin defining frame 132 made of an electrically conducting material such as metal foil. In FIG. 12, an arm 137 having a pin 133 secured to its front end portion is pivotally supported at its base by the lower end portion of a shaft 127. A lock member 135 is secured to the shaft 127 and is disposed below the arm 134. Mounted on the shaft 127 and disposed between the lock 135 and the arm 134 is a spring 136 which urges the arm 134 to move in the counterclockwise direction in FIG. 11 and to cause the pin 133 to engage one end of a lever 137 from the right in FIG. 11. The lever 137 is pivotally supported by a shaft 138 and is loosely connected at the other end through a shaft 138 to a connector 140 that is in turn pivotally connected to an actuator 139 of a solenoid SOL2.

The actuator 139 of the solenoid SOL2 is in an extended position when the solenoid is deenergized. When the actuator 139 is in this extended position, a connector 140 depresses a switch SW5 as shown in FIG. 12. When the switch SW4-2 which forms a part of the double throw switch SW4-1,2 is depressed, and the switch SW3 is depressed by the charging device 97 restored to its initial position, a command to energize the solenoid SOL2 is issued and the actuator 139 is withdrawn into the solenoid. This causes the lever 137 to move clockwise in FIG. 11, with the arm 134 pivotting and the shaft 127 rotating in slaved relation to the lever 137 under the biasing force of a spring 136.

The rotation of the shaft 127 moves the screen support arm 128 and the screen 130 in the direction of an arrow *h* shown in FIG. 14, so that the margin defining frame 132 is brought into engagement with the margins of the photoreceptor 62 which has just been charged. When the solenoid SOL2 is energized, the switch SW5 is opened. Opening of the switch SW5 does not affect any of the elements shown in the figure.

Figure 17:
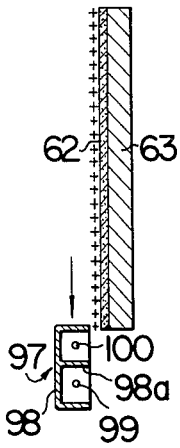
FIGS. 17 through 19 are sectional views showing the charging device and the screen in relation to the photoreceptor of FIGS. 14, 15, and 16.
Figure 18:
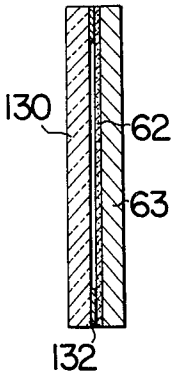
Figure 19:
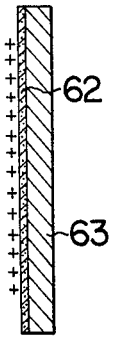

After the procedure described above, the photoreceptor 62 is charged, as shown in FIG. 17, by the charging device 97. When the margin defining frame 132 is brought into engagement with the photoreceptor 62, as shown in FIG. 18, an optimum spacing is maintained between the photoreceptor 62 and the screen 130. Because of the frame 132, the charge carried by the margin of the photoreceptor 62 is removed, as shown in FIG. 19, to thereby prevent adhesion of toner particles to the marginal area of the photoreceptor 62 and to prevent such toner particules from smearing or otherwise detracting from the appearance of the identification card produced later. The margin defining frame 132 of the screen 130 may be electrically grounded by suitable means, or a suitable bias voltage can be impressed on it. Alternately, the electrical charge on the margin of the photoreceptor 62 may be removed by increasing the electrical capacity of the margin defining frame 132.

Referring back to FIG. 12, when the screen 130 is pressed against the photoreceptor 62 that is at the photographing position shown in solid lines in the figure, an optical image of a person or of an object may be projected onto the photoreceptor 62 through the lens 42. A command to release the shutter of the lens 42 is issued, and at the same time a strobe light STL (FIG. 49) is actuated to illuminate the picture or object which is being projected. The optical image formed by the lens 42 is projected onto the photoreceptor 62 through the screen 130, as shown more clearly in FIG. 20. The optical image projected onto the photoreceptor 62 forms an electrostatic latent image thereon. The shutter release switch SW2 may be depressed after the indicating light L2 has been turned on. Prior to shutter release, the casing 41 is correctly positioned vertically by adjusting threaded legs 142 connected to the underside of the casing 41; focusing and trimming are checked through the window 44.

Referring to FIG. 12, the solenoid SOL2 is deenergized when a deenergization command is issued upon completion of the shutter release. This moves the actuator 139 to its extended position to thereby return the screen support arm 128 and the screen 130 to their original positions through the connector 140, lever 137, arm and shaft 127. The switch SW5 is depressed again. The drive mechanism 104 which provides the driving power for the operations described above includes a gear 143 meshing with the gear 103 and substantially integral with the pulley 101 for pulling the charging device 97 by a wire 102. A worm gear 145 meshes with a gear 144 which is affixed to an end of the shaft 82 which is journalled on the support 87 and mounts the photoreceptor support plate 81. The shafts 146 and 147 to which the gear 143 and the worm gear 145 are affixed are rotatably supported by supporters 149 and 150 affixed to a pivotal bar 148. Secured to the shafts 146 and 147 are gears 151 and 152 respectively which mesh with a normally rotating prime worm gear 153. The pivotal bar 148 is pivotally supported by a shaft 154 for the worm gear 153, and the range of pivotal movement of the bar 148 is defined by a fixed pin 155 received in a slot 148*a* formed in the bar 148.

A pin 156 is secured to a lower end portion of the pivotal bar 148 and is in engagement with a fork 157*a* of a selector 157. The selector 157 is supported by a shaft 158 rotatably supported by a fixed member (not shown) and includes arms 157*b* and 157*c* extending symmetrically therefrom to the right and to the left and connected through springs 159 and 160 to the solenoid SOL1 and to another solenoid SOL3 respectively.

When both solenoids SOL1 and SOL3 are deenergized, they pull on the selector 157 with equal force, and therefore the pivotal bar 148 is placed by the selector 157 in a neutral position. In this neutral position of the bar 148, the gear 143 and the worm gear 145 are away from the gear 103 and the gear 144 respectively. Assuming that the solenoid SOL1 is energized upon receipt of a command to begin charging, the pivotal lever 148 is pushed by the selector 157 and moves counterclockwise about the shaft 154 to bring the gear 143 into meshing engagement with the gear 103. At this time, the pivotal bar 148 depresses with its lower portion a switch SW6 disposed to the right of the bar 148. The function of the switch SW6 is described below.

The solenoid SOL1 is deenergized when the double throw switch SW4-1,2 is depressed by the movement of the charging device 97 from its initial position to thereby release the gear 143 from engagement with the gear 103.

After an electrostatic latent image is formed on the photoreceptor 62, the solenoid SOL3 is energized, and the pivotal bar 148 moves clockwise about the shaft 154 to bring the worm gear 145 into meshing engagement with the gear 144. This transmits the driving force of the prime worm gear 153 to the shaft 82 and rotates that shaft in the direction of the arrow *d* in FIG. 12 and simultaneously charges the coil spring 90. The rotation of the shaft 82 moves the arm means 83 in the same direction, and the support plate 81 for the photoreceptor 62 meanwhile moves in slaved relation because of the biasing force of a spring 85 to thereby move the photoreceptor 62 from the photographing position shown in solid lines in FIG. 12 to a transfer printing position.

Figure 20:
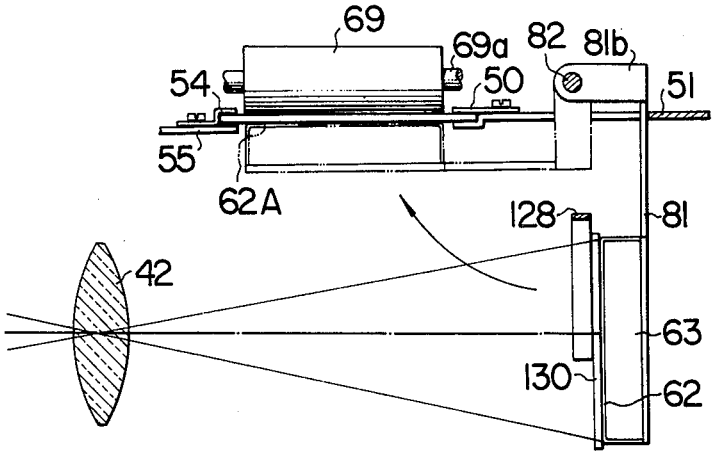
FIG. 20 is a schematic view showing the photoreceptor in a photographing position and in a transfer-printing position.

The transfer printing position of the photoreceptor 62 is shown in dash and dot lines 62*a* in FIG. 20. In its tranfer-printing position, the photoreceptor 62 is in pressing engagement with the dielectric material layer of the card material 49 in order to transfer the electrostatic latent image from the photoreceptor 62 onto the card material 49.

Referring back to FIG. 12, the cam 88 is rotated angularly through an angle of a little over 90° by the shaft 82, and a front end 161*a* of a connector 161, which engages the arcuate major diameter portion 88*a* of the cam 88, is released from that engagement and is brought into engagement with one end of a minor diameter portion 88*b* of the same cam 88. The connector 161 is slidably supported by fixed shafts 162 and 163 extending through slots 161*b* and 161*c* respectively, and has at its back end a bent portion 161*d* maintained in engagement with an actuator 164 of a switch SW7 to depress that switch.

The connector 161 shifts in the direction of an arrow *i* in FIG. 12 when its front end 161*a* engages one end of the minor diameter portion 88*b* of the cam 88. This causes the actuator 164 to open the switch SW7, thereby deenergizing the solenoid SOL3. At the same time, a drive shaft 166 of a drive mechanism 165 for driving the transfer-printing roller 69 is driven to cause the shaft 66 to rotate in the direction of an arrow *j* in FIG. 12. When the solenoid SOL3 is deenergized, the driving force exerted by the drive mechanism 104 on the shaft 82 is removed, and the shaft 82 tends to rotate in a direction opposite that of the arrow *d* because of the biasing force of the coil spring 90. However, rotation of the shaft 82 at this time is precluded by the front end 161*a* of the connector 161 which engages the shoulder of the major diameter portion 88*a* of the cam 88 which is contiguous with one end of the minor diameter portion 88*b* of the same cam. Thus, the photoreceptor 62 is maintained in pressing engagement with the card material 49.

Figure 22:
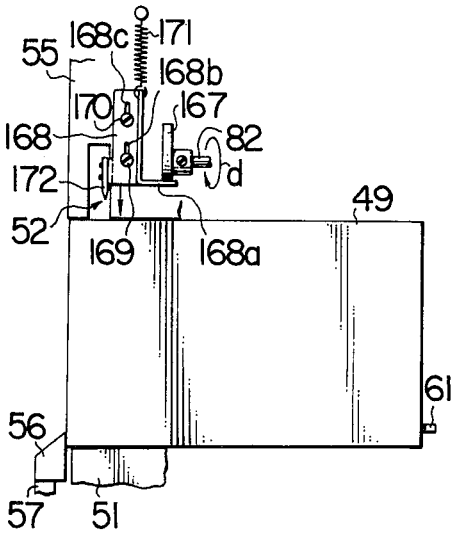
FIGS. 22 and 23 are plan views showing the manner in which a card material is grounded.
Figure 23:
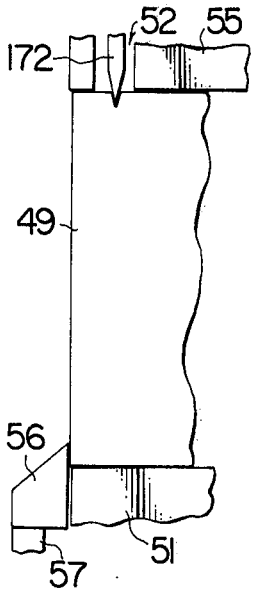
Figure 24:
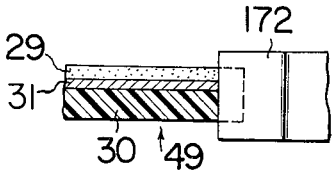
FIG. 24 is a sectional view of a card material and a knife used in conjunction therewith.

For the transfer-printing operation, it is important that the conductive material layer 31 of the card material 49 be electrically grounded or connected to a suitable reference potential. This operation is described by reference to FIGS. 12, 22, and 24. Referring to FIG. 12 an eccentric cam 167 is affixed to an end portion of the shaft 82 on the supporter 86 side thereof. The cam 167 is adapted to push and move a bent edge 168*a* of a ground connector 168 when the shaft 82 rotates angularly through and angle of slightly over 90°. The connector 168 is supported for movement toward and away from the card material 49 by fixed shafts 169 and 170 which are received in slots 168*b* and 168*c* respectively formed in the connector 168. Referring to FIG. 22, the connector 168 is disposed in a position in which it is away from the card material 49 because of the biasing force of a spring 171 mounted on the connector 168 when the bent edge 168*a* is not pushed by the cam 167. A knife 172 is affixed to the connector 168. When the bent edge 168*a* is pushed and moved by the cam 167, the knife 172 moves through the cutout 52 in the support plate 55 toward a side edge of the card material 49 and cuts into that side edge as shown in FIGS. 23 and 24 to thereby electrically ground the conductive material layer 31, and to fix the position of the card material 49. It should be clear that the conductive material layer 31 may be connected to a suitable reference potential instead of being grounded.

Figure 25:
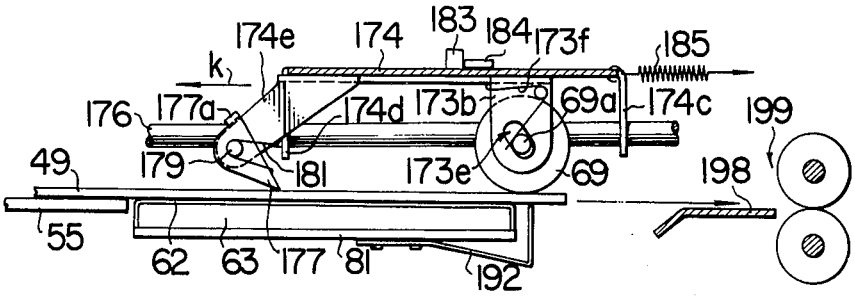
FIGS. 25 through 27 are sectional views of a transfer printing device and illustrate a transfer printing step.

The transfer printing operation is carried out with the help of the transfer-printing roller 69 which is rotatably supported, as shown in FIG. 12, by legs 173*a* and 173*b* of a stay 173. Referring to FIG. 25 for greater clarity, each of the legs 173*a* and 173*b* (only 163*b* is shown) has a slot 173*e* whose upper end is tilted in the direction of movement of the transfer-printing roller 69. The roller 69 is supported by a shaft 69*a* which in turn is loosely received in the slots 173*e* of the stay 173 and is urged downwardly by the biasing force of a spring 173*f.*

The transfer-printing roller 69 is driven by a mechanism 165 which includes a stay 173 fixed to the underside of a carrier 174 that has legs 174*a*, 174*b*, 174*c* and 174*c* slidably supported on parallel rails 175 and 176. Disposed near the legs 174*b* and 174*d* are arms 174*e* and 174*f* which pivotally support pawls 177 and 178 respectively through shafts 179 and 180. Springs 181 and 182 are mounted on the shafts 179 and 180 and also between the arms 174*e*, 174*f* and pawls 177, 180 respectively to urge the pawls 177 and 178 to their open position. The pawls 177 and 178 are maintained in their open positions by bent portions 177*a* and 178*a* thereof which abut the arms 174*e* and 174*f* respectively.

Referring to FIG. 25, the upper surface of the carrier 174 includes a projection 183 positioned against one end 184*a* of a pressing lever 184. Connected to the back end of the carrier 174 is a spring 185 which urges the carrier 174 rightwardly. As a result, the projection 183 abuts the front end of the lever 184, and in this state the carrier 174 depresses a switch SW8 whose operation is described below.

Referring back to FIG. 12, the pressing lever 184 is pivotally supported by a shaft 186 and has at the underside of its other portion a pin 187 that engages a minimum diameter portion of a gradually increasing diameter cam 188 affixed to the drive shaft 166 to which is also affixed a disc 190 having a pin 189 and formed with a cutout 190*a.* When the shaft 166 is not rotating, an actuator 191 of a switch SW9 is in engagement with the cutout 190*a* and the switch is open.

When the switch SW7 is opened and the shaft 166 begins to rotate in the direction of the arrow *j*, the pressing lever 184 is gradually pushed out by the cam 188 to move the carrier 174 in the direction of an arrow *k* (FIG. 25) against the biasing force of a spring 185. This makes the transfer printing roller 69 move in slaved relationship to roll over the card material 49. At the same time, the switch SW8 is opened.

Referring to FIG. 25, the transfer printing roller 69 starts from its initial position shown in the figure and moves in the direction of the arrow *k* in rolling motion while it is pressed downwardly by the biasing spring 173*f.* The dielectric material layer 29 of the card material 49 is maintained in intimate contact with the photoconductive material layer of the photoreceptor 62 at this time.

In order to ensure good quality of the electrostatic latent image transferred to the card material 49, the card material 49 is stripped away from the photoreceptor 62 as the roller 69 is moved. This is explained in connection with FIGS. 25 through 27 which show a resilient plate member 192 that has a base affixed to the back of the support plate 81 for the photoreceptor 62 and a free end adapted to be positioned against the leading right portion of the card material 49 when the photoreceptor 62 is placed at its transfer-printing position.

Figure 26:
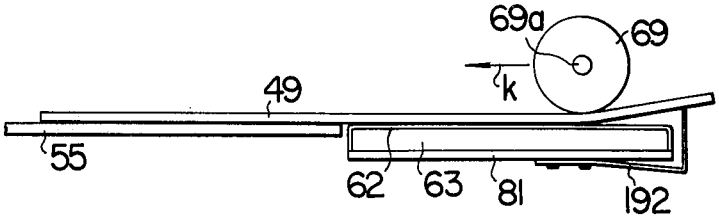
Figure 27:
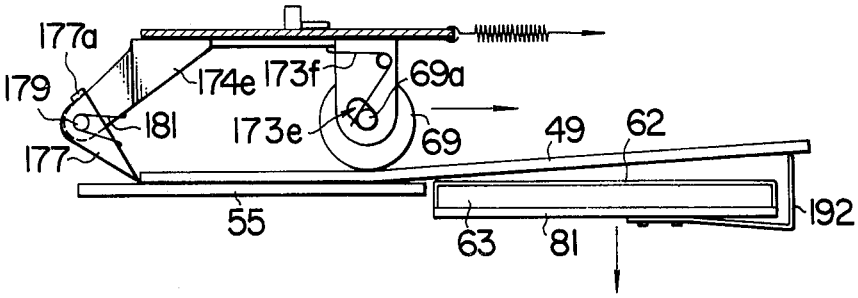
Figure 28:
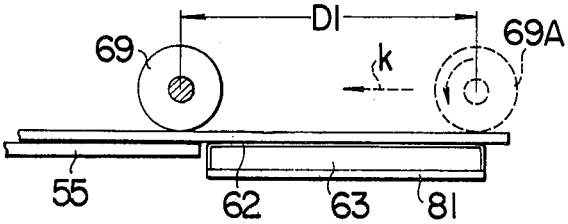
FIG. 28 is a schematic view showing the range of movement of a transfer-printing roller used in the transfer-printing device of FIGS. 25 through 27.

When the transfer-printing roller 69 is in its initial position shown in FIG. 25, the free end of the plate member 192 is flexed down. However, when the transfer-printing roller starts moving in the direction of the arrow *k*, the card material 49 starts being stripped and moved upwardly under the action of the resilient plate member 192, as shown in FIGS. 26 and 27.

Figure 29:
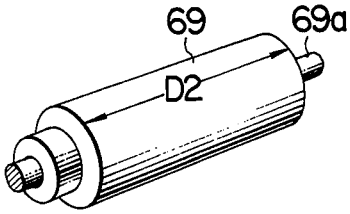
FIG. 29 is a perspective view of the transfer-printing roller showing its construction.

After the roller 69 has moved all the way to the left to carry out the transfer-printing operation, the pressing lever 184 which pushes and moves the pin 183 on the carrier 174 is pushed out and brought into engagement with a maximum diameter portion of the cam 188 and is rapidly brought into engagement with the minimum dimension portion of the same came 188 so as to start moving the carrier 174 back to its starting position under the biasing force of the spring 185. By the time the pressing lever 184 is pushed out by the maximum diameter portion of the cam 188, the transfer-printing roller 69 is at the position shown in FIG. 27 in which the transfer-printing of the latent image is finished. At this time the pawls 177 and 178 are in engagement with the trailing edge of the card material 49 after sliding leftwardly on its surface. Thus, when the carrier 174 starts moving rightwardly to its initial position, the pawls 177 and 178 move the card material 49 forwardly (to the right in FIGS. 25 through 27). At this time, the knife 172 disengages the card material 49. The range of movement of the transfer-printing roller 69 is defined by the longitudinal dimension D1 of the latent image while its transverse dimension is defined by an optimal pressing width D2 (FIGS. 29 and 8) of the roller 69.

When pushed out by the maximum diameter portion of the cam 188, the pressing lever 184 engages the release lever 196 which in turns moves the lock lever 115 away from the actuator 111 of the double throw switch SW4-1,2. The actuator 111 is thus allowed to be moved away from the switch by the biasing spring 114 to thereby open the switch SW4-1,2.

The disc 190 rotates while depressing the actuator 191 of a switch SW9. The pin 189 of the disc 190 engages the lever 193 at the terminating stages of rotation of the disc 190 and pushes that lever 193. The lever 193 has a fork 193*a* engaging a pin 195 of the connector 161. Thus, the lever 193 moves the connector 161 in a direction opposite that of the arrow *i*. This depresses the switch SW7 again, and the front end 161*a* of the connector 161 is released from the cam 88. The switch SW9 serves to continue to maintain the drive shaft 166 operative after the switch SW7 is depressed again. Thus, it is when the actuator 191 of the switch SW9 is brought into engagement with the cutout 190*a* of the disc 190 that the drive shaft 166 stops rotating. At this time the lever 184 has been brought into engagement with the minimum diameter portion of the cam 188 and the transfer-printing roller 69 has been returned to its initial position. The double throw switch SW4-1,2 has just been opened.

When the front end 161*a* of the connector 161 is released from the cam 88, the shaft 82 is also freed. As a result, the support plate 81 of the photoreceptor 62 is restored to its original position by the action of the spring 90, and the shaft 82 returns to its original position to thereby restore cams 88 and 167 to their original positions. The grounding connector 168 releases the knife 172 from the card material 49 and restores the knife 172 to its original position. The release of the knife 172 from the card material 49 takes place slightly earlier than the start of the return movement of the carrier 174, so that the card material 49 can be moved out by the pawls 177 and 178.

Residual charge from the photoreceptor 66 is removed by a lamp L3 which is on when the double throw switch SW4-1,2 is open to illuminate the photoreceptor 62 when it is in the photographing position.

It should be clear that the solenoid SOL1 and SOL3 and the pivotal bar 148 of the drive mechanism 104 discussed above may be replaced by a combination of a wrapping connection device and a clutch.

After the operations described above are completed, the card material 49 bears an electrostatic latent image, and it is moved forwardly by the pawls 177 and 178. The card material 49 is passed through a guide plate 198 and a pair of rollers 199 (FIG. 25) and is fed to a developing device 200 (shown in FIG. 40) for developing of the electrostatic latent image thereon.

Figure 44:
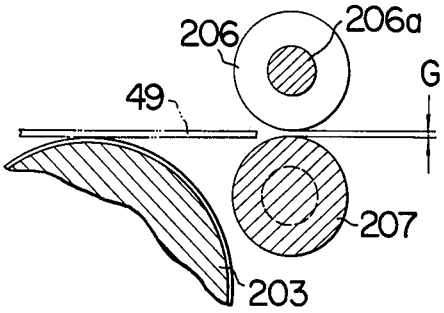
Figure 47:
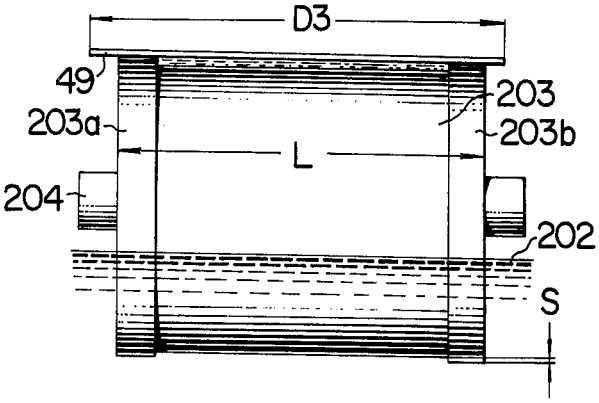

Referring to FIG. 44 for an explanation of the developing operation, the card material 49, with the electrostatic latent image thereon facing downwardly, if fed forwardly in the direction of the arrow *m* by the rollers 199. A container 201 contains a developing agent comprising fine particles of a pigment, such as carbon black treated with a resin in a carrier liquid of high electrical resistance, such as petroleum. A developing roller 203 is made of the same material as the developing roller 34 discussed in connection with FIG. 6 and has flanges 203*a* and 203*b* (shown in FIG. 47) so that its peripheral surface has a width slightly greater than the transverse dimension of the latent image on the card material 49 but is less than the transferse dimension of the card material 49. In order to provide a sufficient quantity of developing agent 202, the developing roller 203 rotates in the direction of an arrow *l* at a rate greater than the rate at which the card material 49 is conveyed. The bottom of the developing roller 203 is immersed in the developing agent 202. The height S of the flanges 203*a* and 203*b* is such that the developing surface of the roller 203 and the portion of the card material 49 which bears the latent image are spaced apart from each other to preclude degrading the image on the card material 49. Such degrading would occur by streaking and otherwise if the developing roller contacted the latent image portion of the card material 49 and if the relative speeds between the two contacting surfaces were different. It has been found that the optimum value of the distance S (FIG. 47) is in the range from about 0.2 mm to 1 mm. The distance L (FIG. 47) between the opposite ends of the roller 203 is slightly smaller than the width D3 of the card material 49 so as to prevent developing agent from reaching the top surface of the card material 49. The developing roller 203 is supported by a shaft 204 which is in turn rotatably supported by suitable means and is adapted to be rotated continuously.

Figure 45:
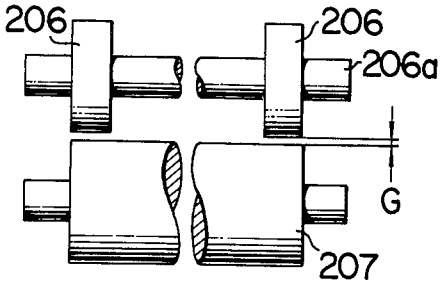

Referring back to FIG. 40, a hold-down roller 205 is to the left of the developing roller 203 and above the path of the card material 49. A hold-down roller 206 consisting of two roller elements and a squeezing roller 207 press against each other and are disposed to the right of the developing roller 203 and rotate in the indicated directions. The roller 206 is supported by a shaft 206*a* which is in turn rotatably supported by an arm 208. The arm 208 is supported by a shaft 209 and is bent at one of its ends to form a bent edge 208*b*. This bent edge 208*b* has an opening 208*a* that loosely receives a screw 211 threadably connected to a fixed plate 210. The screw 211 has a spring 212 which urges the arm 208 downwardly through a washer 213. An adjusting screw 214 is threaded into the bent edge 208*b* so that its front end abuts the plate 210. By turning the adjusting screw 214, it is possible to adjust the gap G between the two rollers 206 and 207 (FIGS. 11 and 45).

Figure 40:
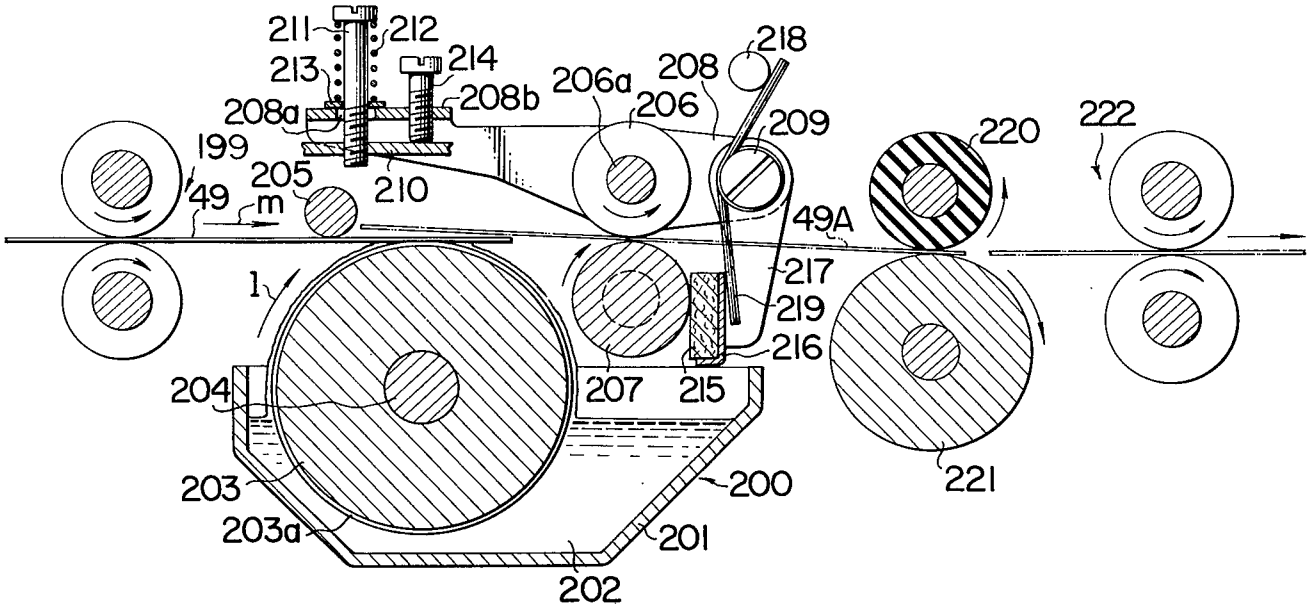
FIG. 40 is a sectional view of a developing device for a card material.

Referring to FIG. 40, the circumferential surface of the squeezing roller 207 is made of a hard material such as a metal, and a cleaner 215 made of a material such as felt is maintained in pressing engagement with the roller 207. The cleaner 215 is supported on a frame 216 affixed to an arm 217 which is loosely mounted on the shaft 209. A spring 219 mounted on the shaft 209 engages at one of its end a fixed pin 218 and urges by its other end the cleaner 215 in pressing engagement with the roller 207.

Figure 43:
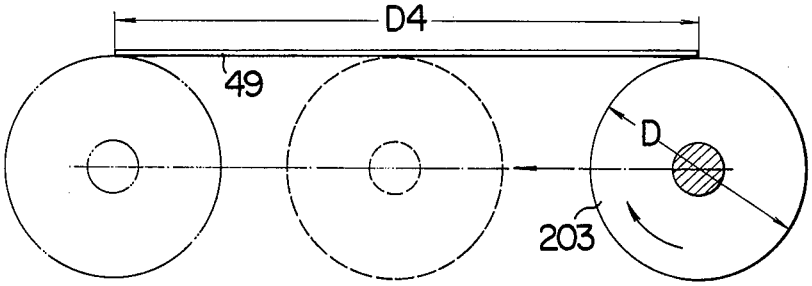

A hold-down roller 220 and a blotter roller 221 are maintained in pressing engagement and rotate in the indicated directions to feed the card material 49 to the right in FIG. 40. The dimensions of the blotter roller 221 are such that its circumference is equal to the length of the card material 49 (i.e., the circumference of the roller 221 of FIG. 40 is equal to the length D4 of the card material 49 shown in FIG. 43).

When the card material 49 is conveyed with its image bearing surface facing downwardly by the pair of conveyor rollers 199 in the direction of the arrow *m* in FIG. 40, the card material 49 moves while being held down by the hold-down roller 206, and its leading end is brought into engagement with the periphery of the developing roller 203. Developing agent 202 is supplied to the image bearing surface of the card material 49 by the developing roller 203. After the developing roller 203, the leading end of the card material 49 is nipped by the rollers 206 and 207 and is moved toward the rollers 220 and 221. The dimensions of the developing roller 203 are such that its circumference is slightly greater than the longitudinal dimension D4 of the card material 49. The distance between the top of the developing roller 203 and the point of contact between the hold-down roller 220 and the blotter roller 221 is slightly smaller than the longitudinal dimension D4 of the card material 49.

Figure 42A:
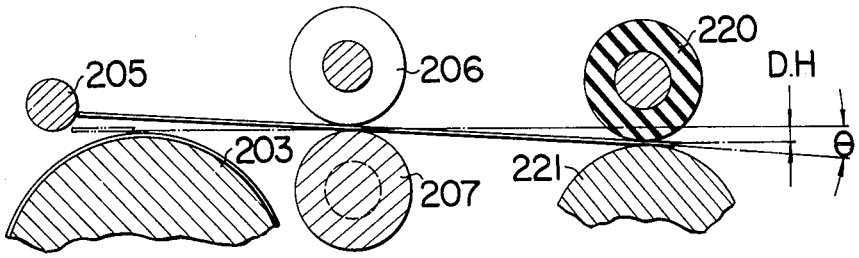

When the card material 49 is at the position designated 49*a* in FIG. 40, i.e., the position at which the leading edge of the card material 49 is nipped by the rollers 220 and 221, the trailing end of the card material 49 is released from engagement with the hold-down roller 205. The gap between the rollers 206 and 207 is at a position which is higher than the gap between the rollers 220 and 221, such that the leading end of the card 49 which is between the rollers 220 and 221 is lower than the rest of the card material 49. Referring to FIG. 42*a*, the leading end of the card material 49 which is between the rollers 220 and 221 is lower than the portion of the card material 49 that is between the rollers 206 and 207 by a distance D.H, and the card is inclined, with its leading end downwardly, by an angle $\theta$. The distance D.H is preferably 1 mm to 10 mm.

Figure 41:
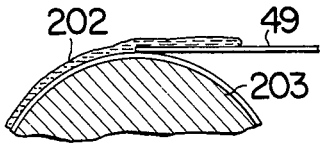
FIGS. 41 through 47 are schematic views showing various parts of the developing device of FIG. 40.

When the card material 49 is at the position 49A, it moves along an inclined path in which the leading edge of the card material 49 is lower than its trailing end, and the trailing end is released from engagement with the developing roller 203 as shown in FIG. 42*a*. This is effective to prevent the staining of the underside of the card material 49 by developing agent thrown over the trailing edge of the card material 49, i.e., the situation illustrated in FIG. 41 is prevented so that the upper side of the card material 49 remains free of smears.

The electrostatic latent image on the card material 49 is developed into a visible toner image by the developing agent supplied by the roller 203, and the card is then ejected from the casing 41 by a pair of discharge rollers 222.

Figure 46:
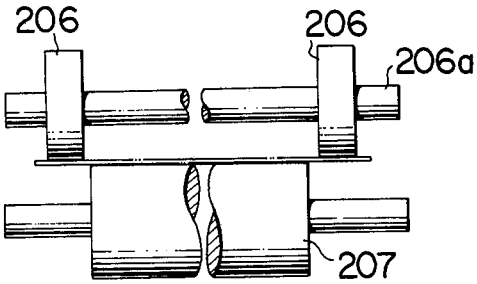

The hold-down roller 206 shown in FIG. 40 may alternately comprise two roller elements axially spaced from each other. This alternate embodiment of the hold-down roller 206 is shown in FIG. 45 and comprises the two rollers 206 axially spaced from each other and supported by a common shaft 206*a*. The spacing between the rollers 206 may be as shown in FIG. 45, or it may be as shown in FIG. 46 where the rollers 206 are axially outwardly of the axially opposite ends of the roller 207.

Figure 42B:
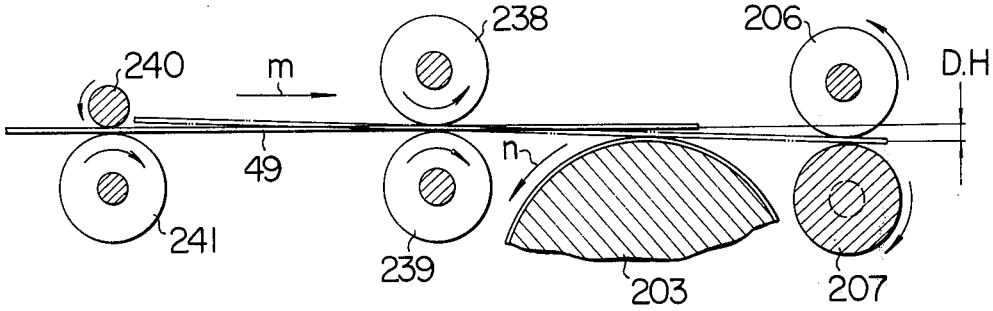

The developing roller 203 shown in FIG. 42 rotates in the direction of an arrow *n* which is opposite to the direction of the arrow *l* shown in FIG. 40, while the card material 49 in FIG. 42*b* moves in the direction of the arrow *m* as in the case of the card material 49 of FIG. 40. Because the developing roller 203 and the card material 49 move in opposite directions in FIG. 42, the relative speed between the two becomes high and the angular speed of the developing roller of FIG. 42 can be reduced to substantially less than the anglular speed of the developing roller shown in FIG. 42*a*. However, since the card material 49 receives a supply of the developing agent at its leading end, the top surface of this leading end portion of the card material 49 in FIG. 42*b* may be stained with developing agent. This can be precluded by rollers arranged in the manner shown in FIG. 42*b* where the card material 49 is fed and flexed in the indicated manner. In FIG. 42*b*, the relative heights of the circumferential surfaces of the shown rollers 241, 239, 203 and 207 are such that the leading end of the card material 49 is spaced from the developing roller 203 as the card material 49 is fed to the right in FIG. 42*b*. Then, the leading end of the card material 49 is moved downwardly by the roller 206, while the trailing end of the card material 49 is released by the hold-down roller 240, such that the card material 49 moves to the position shown in broken lines in the figure, in which position the image bearing portion of the card material 49 is against the developing roller 203, and the image can be developed into a visible image. With the relative positions of the rollers 240, 241, 238, 239, 203, 206 and 207 as shown in FIG. 42*b*, staining of the backside (top side) of the card material 49 is prevented and only the latent image is developed into a visible image.

Figure 48:
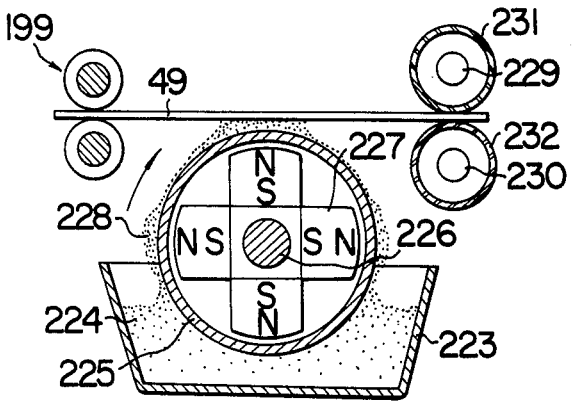
FIG. 48 is a sectional view of a modification of the developing device according to the invention.

The electrostatic latent image on the card material 49 may be developed by developing agents other than the wet developing agent discussed above. FIG. 48 shows a developing device using a dry developing agent and comprising a container 223 storing a quantity of dry developing agent 224 consisting of a toner and iron powder or other ferromagnetic carrier, and a cylinder 225 made of aluminum or other nonmagnetic material and immersed partly in the developing agent 224. Built in the cylinder 225 are a plurality of magnets 227 supported by a shaft 226. The magnets 227 are rotated in the direction of the shown arrow at a rate higher than the rate of movement of the card material. In the device of FIG. 48, the dry developing agent 224 forms a magnetic brush 228 on the outer periphery of the cylinder 225, as defined by the magnetic field of each magnet 227. The magnetic brush 228 moves with the cylinder 225 as the magnets 227 rotate, and it brought into sliding engagement with the latent image bearing surface of the card material 49, so that the toner supplied to the electrostatic latent image develops it into a visible toner image. The card material 49 is then nipped by a pair of fixing cylinders 231 and 232 having built-in heaters 229 and 230 respectively and maintained in pressing engagement with each other. The toner image of the card material is heated and fixed by the fixing cylinders 231 and 232 before the card material 49 is discharged from the casing 41. It should be understood that other fixing means may be used with the dry developing method described above.

After the card material 49 is discharged from the casing 41, markings serving to identify the card user or other markings may be made on the card material 49. Then, a thin protective film of polyester or other material may be laminated to the surface of the card material 49 to complete the identification card produced in accordance with the invention.

The electrical control device for the identification card producing device discussed above is shown in FIG. 49, in which the contacts of the switches are shown at the positions in which they are when the device is not operating.

Referring to FIG. 49, a motor M1 drives a drive shaft 154 of the drive mechanism 104 that moves the charging device 97 and the photoreceptor 62, a motor M2 drives the developing device 200, and a transformer TR has a secondary driving the strobe light device STL and a secondary supplying power to the indicating light L1 for the main off-on switch. A control circuit 234 includes a high voltage source Ch for impressing a high bias voltage on the charging device 97, a motor M3 for driving the shaft 166 of the drive mechanism 165 for the transfer-printing roller 69, a solenoid SOL1 for actuating the selector of the drive mechanism 104, and a solenoid SOL3 and a solenoid SOL2 for actuating the screen 130 which are connected in shunt with each other and to an alternating current source through a plug 235 and a main off-on switch SW1.

The solenoid SOL1 is connected, through one normally closed switch SW4-1 of the double throw switch SW4-1, 2, to a self-holding circuit 236 comprising the shutter release switch SW2 connected to the main switch SW1, the normally open switch SW8 connected in series to switch SW2, and the normally open holding switch SW6 connected in shunt with switches SW2 and SW6 and with the main switch SW1. The switch SW8 is depressed by the carrier 174 for the transfer-printing roller 69 and is maintained in closed position when the transfer printing roller is at its starting position. The other switch SW4-2 of the double throw switch SW4-1,2 acts as a change-over switch for a circuit comprising the light L2 indicating satisfactory shutter release and the discharging lamp L3 connected in series to lamp L2, and a circuit comprising the solenoid SOL2. When the double throw switch SW4-1,2 is not depressed by the actuator 111, the contact of the switch SW4-2 is engaged with the circuit comprising the indication lamp L2.

The switch SW4-2 and high voltage impressing device Ch are connected to the change-over switch SW3, which in turn is connected to the main off-on switch SW1, and is depressed by the support bar 95 when the charging device 97 is stationary at its initial position with its contact in engagement with the switch SW4-2.

In the circuit comprising solenoid SOL2, the first timer T1 and its switch SW10 are connected in shunt to each other and comprise a first timing device 237, and the solenoid SOL2 is connected in shunt to a relay RL and to a second timer T2 and to switch SW10. A switch SW11 for relay RL connects the first timer T1 and its switch SW10 to the main off-on switch SW1, while a solenoid SOL4 for actuating the shutter and the strobe light device STL is connected to a second timer T2.

The switch SW10 is connected to the normally opened switch SW5 which is depressed and closed by the connector 140 when solenoid SOL2 is deenergized. The switch SW5 is connected to the change-over switch SW7 which is depressed and actuated by the connector 161 for switching between the circuit comprising solenoid SOL3 and circuit comprising motor M3. When the connector 161 abuts the major diameter portion 88*a* of the cam 88, the switch SW7 is depressed by the connector 161 and its contact is engaged by the solenoid SOL3. The motor M3 is connected to the main off-on switch SW1 through the normally open switch SW9 adapted to be actuated by the disc 190 having the cutout 190*a*. However, when the disc 190 is not operating, its actuator 191 is brought into engagement with the cutout 190*a* and the switch SW9 is opened.

When the push-button 45 is depressed to close the main off-on switch SW1, the motors M1 and M2 start rotating and the transformer TR1 is actuated by the current across its primary. Thus the strobe device STL is ready, and the indication lamp L1 is on to indicate that the main off-on switch SW1 is closed. The push-button 45 is of the type which is maintained in an operative position when depressed and can be brought to an inoperative position when pulled out. The satisfactory shutter release indicating lamp L2 and the discharging lamp L3 are turned on through the switches SW3 and SW4-2. The discharging lamp L3 is disposed in a dark chamber of the device, and it is not usually possible to ascertain from outside the device if the lamp L3 is on or off. The lamp L2 is therefore provided so that an operator of the device can readily ascertain whether the discharging lamp L3 is on or off. A tungsten lamp or other suitable types of lamps may be used as the discharging lamp L3.

The push-button 46 is depressed after the operator of the device has ascertained that the main switch SW1 is on (by observing the indication lamp L1) and that the satisfactory shutter release indication lamp L2 is on. The depression of the push-button 46 temporarily actuates the switch SW2 to energize the solenoid SOL1 through the switches SW8 and SW4-1. The solenoid SOL1 is self-held by the closing of the switch SW6 through the pivotal bar 148. The solenoid SOL1 should be self-held because the push-button 46 is of the automatic restoration type, and the switch SW2 is opened when the push-button 46 is released.

After the solenoid SOL is energized, the charging device 97 is moved from its initial position and this brings the switch SW3 into engagement with the high voltage source Ch. Changing over of the switch SW3 to the high voltage source turns off the satisfactory shutter release indicating lamp L2 and the discharging lamp L3, so that the photoreceptor 62 may be charged by the charging device 97 and the shutter may be cocked.

At about the time that the charging device 97 reaches the end of its movement from its initial position toward the photographing position, the actuator 111 is pushed and is moved to depress the double throw switch SW4-1,2. The opening of the switch SW4-1 deenergizes the solenoid SOL1 and moves the charging device 97 back to its initial position. The switch SW4-2 is brought into engagement with the first timer T1 side while the switch SW3 is brought into engagement with the switch SW4-2 by the restoration of the charging device 97 to its initial position.

When the switches SW3 and SW4-2 are brought to the positions discussed immediately above, the first timer T1 is turned on through the switch SW4-2, while the relay RL, the solenoid SOL2 and the second timer T2 are turned on through the switch SW10. The relay RL2 causes the switch SW11 to hold its circuit, and the solenoid SOL2 brings the screen 130 to a position in which it is over the photoreceptor 62. Thereafter, the second timer T2 is turned off to actuate the solenoid SOL 4 which releases the shutter and simultaneously turns on the strobe device STL to make it flash in synchronism with the shutter release. The relay RL is made to close the switch SW11 to hold its circuit for the following reasons: If the charging device 97 bounced one or more times, however slightly, when it is restored to its original position, the switch SW3 may be opened and closed to thereby disturb the solenoids SOL2 and the screen 130. This may cause the switch SW3 to open at an undesirable time and would cause the charging device 97 to stop on its way back to its initial position.

The first timer T1 remains on until the shutter is released. It goes off after the shutter releases to thereby bring the switch SW10 into engagement with the switch SW5 side. The switch SW5 is opened and closed by energization of the solenoid SOL. However, deenergization of the solenoid SOL2 brings the switch SW5 to a closed position. When the switch SW10 is engaged with the switch SW5, the solenoid SOL3 is energized through switch SW7 to thereby rotate the shaft 82 and move the photoreceptor 62 from the photographing position to the transfer-printing position.

After the photoreceptor 62 is brought into the transfer-printing position which it is pressed against the card material 49, the SW7 is brought into engagement with the motor M3 side by the cooperation between the cam 88 and the connector 161 to thereby turn on the motor M3. The motor M3 thus rotates the shaft 166 to move the transfer-printing roller across the back side of the card material 49. The rotation of the disc 190 causes the switch SW9 to thereby turn off the motor M3.

At about the time the transfer-printing roller 69 reaches the end of its movement from its initial position, the double throw switch Sw4-1,2 is opened by the cooperation between the cam 188 and the lever 184, and is restored to its initial position. At this time, the motor M3 is maintained on by the switch SW9 and continues rotating. Thereafter, the switch SW9 is opened by the disc 190, and the motor M3 is turned off.

By this time, the card material 49 on which an electrostatic latent image is formed by transfer-printing from the photoreceptor 62 has moved toward the developing device 200 which is rendered operative by the motor M2. The latent image is developed into a visible toner image by the developing device 200, and then the card material is discharged from the device 41. When the double throw switch SW4-1,2 is restored to its initial position, the lamp L2 which indicates satisfactory shutter release is turned on and the discharging lamp L3 is also turned on to illuminate the photoreceptor 62, which has returned to the photographic position by this time, to thereby remove residual charges from the photoreceptor 62.

The switch Sw8 serves to prevent the charging device 97 from being actuated inadvertently while the transfer-printing roller is in operation.

We claim:

1. Apparatus for producing identification cards comprising: positioning means for placing a relatively stiff sheet of card material at a transfer-printing position, a substantially flat photoreceptor comprising a photoelectric material layer disposed on a conductive supporter, means for poositioning the photoreceptor at a photographing position, charging means for uniformly charging the photoconductive layer of said photoreceptor when the photoreceptor is at its photographing position, means for exposing the charged photoconductive material layer of the photoreceptor to an optical image to form an electrostatic latent image on the photoconductive material layer when the photoreceptor is at its photographing position, means for moving the charged and exposed photoconductive layer to a transfer-printing position at which it is adjacent to and facing the card material, transfer-printing means for pressing the photoreceptor and the card material against each other and for thereby transferring the electrostatic latent image from the photoreceptor to the card material to form an electrostatic latent image on the card material by transfer-printing, means for moving the photoreceptor and the card material apart and for moving the photoreceptor from the transfer-printing position to the photographing position after the latent image has been transferred to the card material, means for developing the latent image on the card material with a developing agent comprising a toner to thereby develop the last recited latent image into a visible toner image, and including means defining a card material passage for inserting a card material forwardly from outside the apparatus toward said transfer printing position of the card material, stopper means and spring means urging the stopper means into the card material passage, said stopper means having an inclined edge for moving the stopper means out of the card material passage as a card material is inserted into the apparatus and having a straight edge facing the transfer-printing position of the card material, and push-back means for pushing the card material which has been inserted into the apparatus and has passed said stopper means back towards the stopper means and against said straight edge of the stopper means to thereby position the card at said transfer-printing position.

2. An indentification card producing apparatus as in claim 1 including a photoreceptor backing plate having a groove and means for securing the photoreceptor over said backing plate and over said groove thereof, the last recited means including clamping means for pushing the portion of the photoreceptor material which is over said groove toward the bottom of the groove to thereby tension and tighten the photoreceptor.

3. An identification card producing apparatus as in claim 1 wherein the means for projecting an optical image on the photoreceptor comprises a mesh screen where the mesh size is beyond the resolving power of the human eye at a distance of normal vision, and means for positioning said screen adjacent the photoconductive material layer when the photoreceptor is at its photographing position.

4. An identification card producing apparatus as in claim 3 wherein said screen includes a marginal portion comprising a margin defining frame extending from the screen towards the photoconductive material layer for spacing the photoreceptor from the screen by a selected small distance.

5. An identification card producing apparatus as in claim 1 wherein the means for positioning the photoreceptor at its photographic position and at is transfer-printing position comprise a plate supporting the photoreceptor, drive means for driving said plate to move the photoreceptor from the photographing position to the transfer-printing position, a spring biasing the plate toward the photographing position of the photoreceptor and cam means for preventing the photoreceptor from returning from the transfer-printing position to the photographing position under the action of the spring means for a selected interval of time.

6. An identification card producing apparatus as in claim 1 wherein said developing means comprise a wet electrophotographic developing agent.

7. An identification card producing apparatus as in claim 1 wherein the developing means comprise a dry electrophotographic developing agent.

* * * * *